US005694989A

United States Patent [19]

Kupelian

[11] Patent Number: 5,694,989

[45] Date of Patent: Dec. 9, 1997

[54] APPARATUS FOR ESTABLISHING NEGATIVE AIR PRESSURE IN A FLUID-CONTAINING TANK

[76] Inventor: Krikor Kupelian, c/o Ruetter Coachworks, Inc., 2207 State Hwy. No. 4, Fort Lee, N.J. 07024

[21] Appl. No.: 631,813

[22] Filed: Apr. 10, 1996

[51] Int. Cl.[6] ..... B65B 1/04

[52] U.S. Cl. ..... 141/65; 141/350; 417/197; 417/179

[58] Field of Search ..... 141/4, 8, 65, 350; 137/142, 147, 888; 417/197, 179; 239/318; 129/204.25

[56] References Cited

U.S. PATENT DOCUMENTS

| | | | |
|---|---|---|---|
| H1159 | 4/1993 | Roach | 417/151 |
| 1,458,523 | 6/1923 | Coutant | 417/197 |
| 2,909,127 | 10/1959 | Bradaska | 417/197 |
| 3,007,322 | 11/1961 | Dodge | 62/268 |
| 3,298,669 | 1/1967 | Zingg | 239/318 |
| 3,840,183 | 10/1974 | Kuribayashi | 239/318 |
| 4,161,957 | 7/1979 | Schoellkopf | 137/205 |
| 4,621,439 | 11/1986 | Maw-Chyi | 34/92 |
| 4,736,489 | 4/1988 | Egan | 15/409 |

*Primary Examiner*—Henry J. Recla
*Assistant Examiner*—Steven O. Douglas
*Attorney, Agent, or Firm*—Hoffmann & Baron, LLP

[57] ABSTRACT

A nozzle for attachment to a fluid-containing tank which is capable of applying negative air pressure to and establishing negative air pressure within the interior of the tank by forcing compressed air flow through the nozzle is provided by the present invention. The nozzle includes a vacuum pipe having an elongated generally cylindrical wall with first and second ends spaced apart, establishing a negative air pressure chamber therein that is capable of fluid communication with the interior of the tank when the nozzle is attached to the tank. The vacuum pipe is attachable to an opening of the tank at one end and open to ambient air at the other end, and openings exist through the wall of the vacuum pipe extending into the negative air pressure chamber. An air flow pipe surrounds the vacuum pipe, establishing an annular chamber therebetween. The air flow pipe is open to ambient air at the end adjacent the end of the vacuum pipe that is open to ambient air. In operation, compressed air is passed into the annular chamber, and the compressed air flows through the openings into the negative air pressure chamber, establishing negative air pressure therein, and further establishing negative air pressure within the interior of the tank.

15 Claims, 4 Drawing Sheets

APPARATUS FOR ESTABLISHING NEGATIVE AIR PRESSURE IN A FLUID-CONTAINING TANK

FIELD OF THE INVENTION

The present invention relates generally to an apparatus for establishing a negative air pressure flow in a fluid-containing tank through an opening of the tank. More specifically, the present invention relates to a nozzle for attachment to a fluid-containing tank which is capable of establishing negative air pressure within the interior of the tank by forcing compressed air flow through the nozzle.

BACKGROUND OF THE INVENTION

The repair of a fluid-containing tank can often be lengthy and tedious due to the effort required to facilitate such repair. Typically, a fluid-containing tank such as a gasoline tank on an automobile will become punctured, causing the fluid within the tank to leak out. This leaking can cause serious problems for the proper functioning of the tank, as well as create environmental and safety concerns when the fluid within the tank is hazardous. For instance, when an automobile gasoline tank is punctured, the gasoline within the tank will leak out, causing the gasoline tank to function improperly by not containing the gasoline within, and further causing the automobile engine to function inefficiently. Further, the leaking gasoline creates serious environmental and safety concerns, since gasoline is a volatile substance.

Conventional methods of repairing a puncture in a tank containing liquid therein typically require draining the tank of any liquid remaining within the tank prior to conducting any repair. In addition to time consumption, this draining may result in waste in that the drained liquid cannot always be recycled for later use. Further, when the liquid within the tank is a volatile substance, any fumes remaining in the tank after the liquid has been drained must also be evacuated prior to attempting any repair.

It is well known that jet type pumps are effective in facilitating the flow of various fluids including air and liquids. A jet type pump typically operates by introducing a fluid stream at high pressure to an apparatus which mixes the high pressure fluid stream with a separate fluid which is to be moved. The force of the high pressure fluid stream causes the separate fluid to be moved along with the high pressure fluid stream. When the separate fluid to be moved is air, the force of the high pressure fluid stream, which is typically a stream of compressed air, creates a vacuum pump in which the air to be moved is forced along with the compressed air stream. In this manner, the compressed air stream forces the separate air to be moved along with the compressed air stream, creating a vacuum.

Various methods and devices have been developed which disclose jet type pumps using various fluid streams such as compressed air to move other fluids. One such device is described in United States Statutory Invention Registration No. H1159 to Roach. This Invention Registration discloses a pneumatic aircraft fuel educator for purging fumes from an aircraft fuel tank after liquid fuel previously contained within the tank has been emptied from the tank. The educator includes a conical tube having a large diameter opening at one end that passes through an access opening of the tank to be purged, and narrows to a smaller opening which connects to a cylindrical tube outside of the tank. An air line passes through the conical tube concentrically and ends as a jet within the conical tube directed toward the cylindrical tube. Pressurized air is passed through the air line and exits the line at the jet in a direction away from the tank opening. The passage of air creates a vacuum which drives a large volume of air from the tank, thus rapidly purging the tank of all fumes.

U.S. Pat. No. 4,134,547 to Gamst describes an improved jet type pump which connects to a water hose for providing a powerful water jet to be used, for instance, as a fire hose. The jet pump comprises a jet nozzle having an inlet pipe through which water flows extending into a converging conical section of an outlet pipe, with an annular opening existing where the outer portion of the inlet pipe meets the inner wall of the outlet pipe. The outlet pipe also has a straight section in continuation of the converging conical section followed by a diverging conical section and a straight outlet section. Pressurized air is introduced into the annular opening to surround the central water flow thereby reducing friction against the outlet pipe wall and creating an increased speed of motion for the water in the outlet portion of the jet pipe.

While these and other devices describe effective jet pumps, they fail to provide a simple design for a jet type pump which creates an efficient negative air flow suitable for facilitating repair of a liquid-containing tank.

Thus, it is apparent that a need exists for an apparatus for facilitating repair of a puncture in a liquid-containing tank that is simple to use and efficient in operation. The present invention fulfills this need by providing a nozzle for creating negative air pressure within a fluid-containing tank that is both simple in design and operation and efficient in use.

SUMMARY OF THE INVENTION

The present invention provides a nozzle for attachment to a fluid-containing tank for applying negative air pressure to the interior of the tank through an opening of the tank. The nozzle includes a vacuum pipe having an elongated generally cylindrical wall having a first open end in communication with the tank opening and a second open end spaced therefrom, defining a negative air pressure chamber between the ends. An air flow pipe having an elongated generally cylindrical wall surrounding the vacuum pipe and defining an annular chamber therebetween. The air flow pipe has an open end adjacent the second open end of the vacuum pipe, and further has an air inlet opening for establishing air flow through the annular chamber and out the open end of the air flow pipe. The vacuum pipe includes openings through it's wall between the first open end and the second open end thereof for permitting the air flow established through the annular chamber to pass through and into the negative air pressure chamber and out the open end thereof. In this manner, negative air pressure is applied to the interior of the tank.

The vacuum tube may include a plurality of openings through the wall between the first open end and the second open end thereof. The openings may be generally cylindrical in shape, and may further be geometrically shaped to direct the air flow passing through the openings towards the second open end of the vacuum pipe.

The vacuum pipe may further have a conical portion adjacent the first open end thereof and an elongated portion extending from the conical portion to the second open end. In such an embodiment, the opening through the wall of the vacuum pipe preferably is present in the elongated portion of the vacuum pipe at a position adjacent the conical portion.

The air flow pipe may include an end wall surrounding the vacuum pipe adjacent the first open end thereof which closes the other end of the air flow pipe. The end wall may be capable of securing the nozzle to the tank in an airtight engagement. To accomplish this airtight engagement, the end wall preferably includes a resilient elastomeric material.

The nozzle may further include an arm for introduction into the tank. Such an arm is capable of engaging a door of the tank and maintaining the door in an open position.

The air inlet opening of the air flow pipe may include a valve for regulating the air flow through the annular chamber.

Preferably, the open end of the air flow pipe extends beyond the length of the vacuum pipe. More preferably, the air flow pipe extends more than ¼ inch beyond the length of the vacuum pipe, and most preferably, extends ½ inch beyond the length of the vacuum pipe.

In an alternative embodiment of the present invention, the air flow pipe has a first end adjacent the first open end of the vacuum pipe and a second end adjacent and connected to the second open end of the vacuum pipe. The air flow pipe further has an airflow deflector surface extending from the first end thereof into the negative air pressure chamber at the first open end of the vacuum pipe. The deflector surface establishes a path of communication between the annular chamber and the negative air pressure chamber for permitting the air flow established through the annular chamber to pass along the deflector surface and into the negative air pressure chamber and out the open end thereof, whereby negative air pressure is applied to the interior of the tank.

In this embodiment, the path of communication between the annular chamber and the negative air pressure chamber is preferably capable of adjustment between an open and a closed position. Preferably, the connection of said second end of the air flow pipe to the second open end of the vacuum pipe permits adjustment of the position of the vacuum pipe within the air flow pipe so as to adjust the path of communication between an open and a closed position. The second end of the air flow pipe may be threadably engaged with the second open end of the vacuum pipe so as to permit adjustment of the position of the vacuum pipe within the air flow pipe.

Further, the deflector surface may be a discrete member. In this embodiment, the first end of the air flow pipe is capable of movable engagement with the deflector surface so as to adjust the path of communication between an open and a closed position. Preferably, the deflector surface is threadably engaged with the first end of the air flow pipe so as to permit adjustment of the path of communication between an open and a closed position.

DETAILED DESCRIPTION OF THE INVENTION

The present invention provides a nozzle for establishing negative air pressure, and further provides a nozzle for attachment to a fluid-containing tank at an opening in the tank for applying and establishing negative air pressure within the interior of the tank. The negative air pressure established within the tank evacuates air that is present within the tank. The nozzle is well suited for facilitating repair of a puncture in a liquid-containing tank, in that the negative air pressure created within the tank is sufficient to prevent the liquid being stored within the tank from draining through the puncture. On the other hand, the negative air pressure flow can be adjusted so as to be not so strong as to cause the liquid to be evacuated from the tank. The nozzle of the present invention is particularly well suited for facilitating the repair of a ruptured gas tank of an automobile and as such will be described with reference thereto. However, it can be appreciated that the present invention may be employed with any of a wide variety of tanks or fluid containers.

The nozzle of the present invention attaches to the liquid-containing tank at an opening of the tank, preferably at the opening where the tank is typically filled. The present invention provides for pressurized or compressed air to flow in a manner such that negative air pressure is created by the nozzle at two separate areas of the nozzle, thus providing an improved and more efficient apparatus for establishing negative air pressure.

Figure 1:
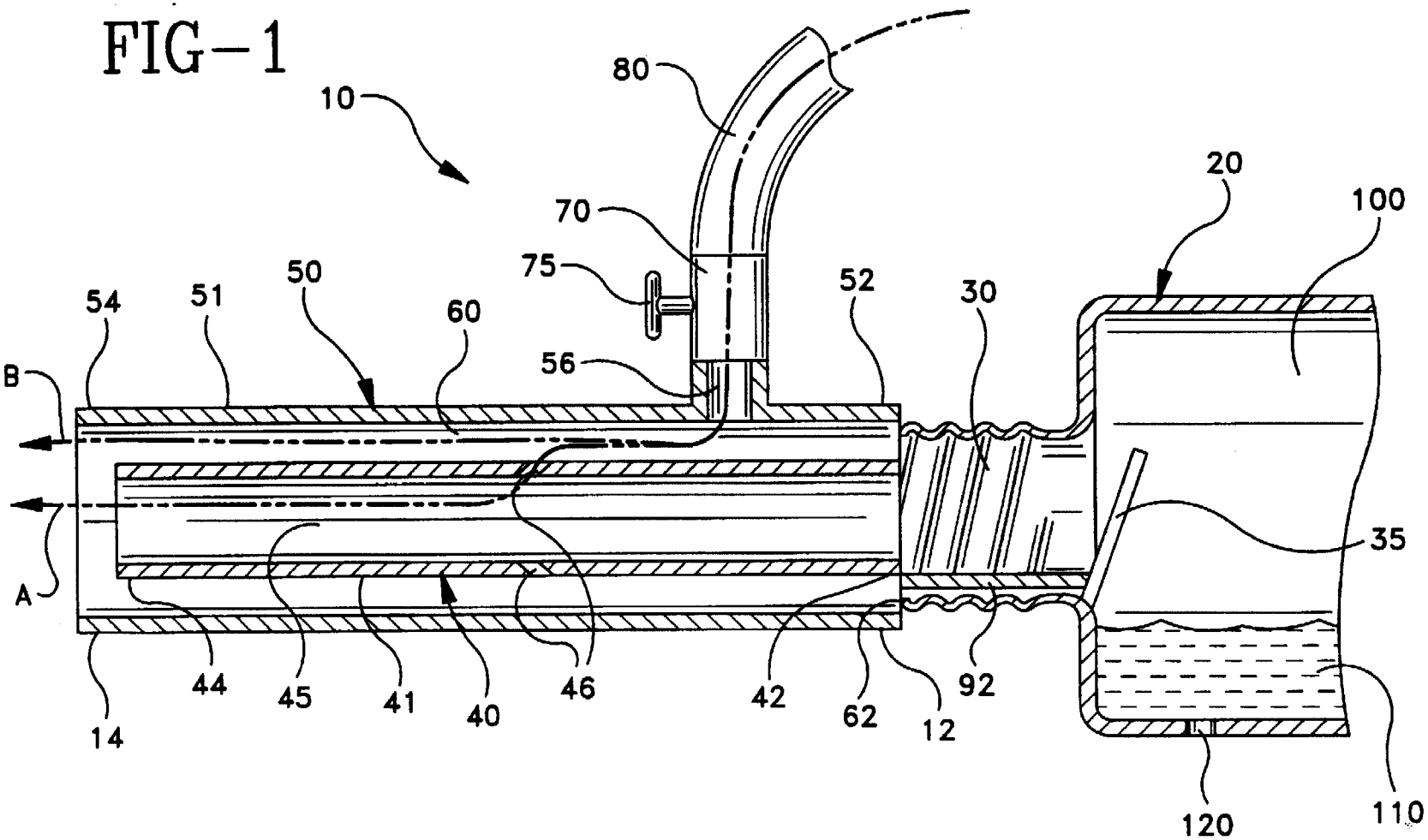
FIG. 1 is a side view of a nozzle in the preferred embodiment of the present invention.

Referring to FIG. 1, the nozzle of the present invention is shown generally at nozzle 10. Nozzle 10 is capable of attachment to a tank 20, which as described above may be a conventional automobile gas tank. Nozzle 10 attaches to tank 20 at a tank opening 30. Nozzle 10 may be employed in any opening in tank 20. It is well within the contemplation of the present invention to attach nozzle 10 to the fill opening of a gas tank.

Nozzle 10 has a first end 12 and a second end 14. Nozzle 10 includes a vacuum pipe 40 having an elongated generally cylindrical wall 41. Vacuum pipe 40 has a first open end 42 that is capable of communicating with tank opening 30. A second open end 44, spaced from first open end 42 of vacuum pipe 40, is open to ambient air. Elongated wall 41 of vacuum pipe 40 defines a negative air pressure chamber 45 between first open end 42 and second open end 44 of vacuum pipe 40. As will be described hereinbelow, negative air pressure is established within negative air pressure chamber 45, permitting air to be evacuated from within tank 20, as tank 20 is attached at tank opening 30 to first open end 42 of nozzle 10.

Nozzle 10 also includes an air flow pipe 50 having an elongated generally cylindrical wall 51. Air flow pipe 50 surrounds vacuum pipe 40. The inner diameter of elongated wall 51 of air flow pipe 50 is slightly larger than the outer diameter of elongated wall 41 of vacuum pipe 40 such that, with air flow pipe 50 surrounding vacuum pipe 40, an annular chamber 60 is defined between the two pipes. Air flow pipe 50 includes a first end 52 adjacent the first open end 42 of vacuum pipe 40. An annular end wall 62 surrounds vacuum pipe 40 near end 42 and closes the end of annular chamber 60. End wall 62 may be formed of an elastomer such as rubber to seal the end of annular chamber 60. As will be discussed in further detail hereinbelow, end wall 62 may also be used to sealingly attach nozzle 10 to tank 20.

Air flow pipe 50 has an open end 54 adjacent second open end 44 of vacuum pipe 40. Open end 54 of air flow pipe 50 is open to ambient air, as is second open end 44 of vacuum pipe 40. Air flow pipe 50 extends slightly beyond the length of elongated wall 41 of vacuum pipe 40 at open end 54. Air flow pipe 50 extends beyond vacuum pipe 40 for a distance preferably greater than about ¼ inch, most preferably extending beyond vacuum pipe 40 about ½ inch.

Air flow pipe 50 includes an air inlet opening 56 for permitting air to be injected into annular chamber 60 so as to establish a flow of air therethrough. The positioning of air inlet opening 56 is not important as long as sufficient air flow is capable therethrough. While the present invention is described in terms of establishing air flow through the air inlet opening, it can be appreciated that any suitable fluid may be used with the present invention for establishing a flow of fluid which would establish negative air pressure within the tank in a similar manner.

Attached to air inlet opening 56 is a valve 70 which accommodates a hose 80 for the supply of compressed air. Valve 70 may have a regulator 75 for regulating the pressure of the flow of air supplied by hose 80. Alternatively, the air flow can be regulated by other means known in the art, such as an adjustment valve on the hose supplying the compressed air to the air inlet.

Vacuum pipe 40 includes a plurality of openings 46 through elongated wall 41 which establish fluid communication between annular chamber 60 and negative air pressure chamber 45. Openings 46 can be any desired shape or number, provided they extend through elongated wall 41 of vacuum pipe 40, and into negative air pressure chamber 45. Preferably, openings 46 are cylindrical shaped, and most preferably openings 46 are geometrically shaped such that air flowing through openings 46 is directed towards second open end 44 of vacuum pipe 40 that is open to ambient air.

As mentioned above, nozzle 10 is capable of attachment to tank opening 30, thereby establishing a fluid communication between the inside of tank 20 and negative air pressure chamber 45. Any known type of mechanical coupling or attachment may be used in order to attach nozzle 10 to tank 20. Preferably, the attachment of nozzle 10 to tank 20 is accomplished in a manner such that an airtight engagement is created between nozzle 10 and tank 20. Such an air tight relation assists in establishing a more efficient negative air pressure flow within tank 20 during operation of the nozzle. It is contemplated by the present invention that end wall 62 is capable of securing nozzle 10 to tank 20 at or about the tank opening 30. End wall 62 may be constructed of a resilient elastomer material which will assist in establishing an air tight engagement between nozzle 10 and tank 20. It is also contemplated that end wall 62 be constructed of other material and may include a resilient elastomer material on a portion thereof which is to be attached to tank 20, such that the resilient elastomer material is capable of providing an air tight engagement between nozzle 10 and tank 20.

As mentioned above, nozzle 10 may be inserted through the conventional fill opening of a tank (shown as tank opening 30). It is common for tank opening 30 to include a flap-like door 35 that maintains tank 20 sealed off from the environment. In order to establish a proper connection between nozzle 10 and tank opening 30 having such a door 35, it is necessary to maintain door 35 in an open position. Nozzle 10 may include an arm 92 which is capable of engaging door 35, and further maintaining door 35 in an open position during operation of nozzle 10.

In operation, nozzle 10, including vacuum pipe 40 surrounded by air flow pipe 50, is attached to tank opening 30. This attachment provides a path for fluid flow from the inside of tank 20, through negative air pressure chamber 45 and out second open end 44 of vacuum pipe 40 to ambient air. Hose 80 which accommodates compressed air is attached to air inlet means 56 of air flow pipe 50. The compressed air is preferably applied at about 100–125 psi (pounds per square inch), most preferably at about 125 psi. When the compressed air is applied, the air flow (indicated by arrow A) is forced through air inlet opening 56, into annular chamber 60, through openings 46 of vacuum pipe 40 and into negative air pressure chamber 45. As vacuum pipe 40 is attached to tank 20 at first open end 42, negative air pressure chamber 45 is open at first open end 42 to the inside portion of the tank 20, and open at second open end 44 to ambient air. The air flow into negative air pressure chamber 45 is thus directed toward second open end 44 of vacuum pipe 40 which is open to ambient air.

With the air flowing through negative air pressure chamber 45 toward second open end 44 of vacuum pipe 40, air that is present within tank 20 mixes with the air traveling through negative air pressure chamber 45. This mixture of air causes the air that is within tank 20 (indicated by arrow B) to move with the flowing air being forced through negative air pressure chamber 45 via openings 46. The mixture of flowing air establishes negative air pressure within negative air pressure chamber 45, and this negative air pressure causes the air within tank 20 to be evacuated out to ambient air.

Since the air flow is directed through the openings 46 into negative air pressure chamber 45, and negative air pressure chamber 45 is open to ambient air at second open end 44, the air flowing through negative air pressure chamber 45 comes into contact with ambient air existing as stationary atmospheric air. This contact of the flowing air and stationary air creates a drag on the air traveling within negative air pressure chamber 45, and this drag causes inefficiency in flow of air established within negative air pressure chamber 45. To compensate for this inefficiency, a second flow of air is established at a second portion of negative air pressure chamber 45. This second flow of air within negative air pressure chamber 45 is accomplished by the air flow pipe being open to ambient air at its open end 54 adjacent second open end 44 of vacuum pipe 40, and by air flow pipe 50 extending slightly beyond vacuum pipe 40. With open end 54 of air flow pipe 50 being open to ambient air, the air flow through annular chamber 60 has an exit path to the ambient air that is in addition to the path of air travel through openings 46 of vacuum pipe 40. As the air flows through annular chamber 45, the air passes through openings 46 and into negative air pressure chamber 45, and additionally continues through annular chamber 60 and out to ambient air through open end 54 of air flow pipe 50. Since open end 54 of air flow pipe 50 extends beyond second open end 44 of vacuum pipe 40, the air exiting negative air pressure chamber 45 is mixed with the air exiting air flow pipe 50 in a direction of flow toward ambient air. The mixing of the flowing air with the air within negative air pressure chamber 45 establishes additional negative air pressure at the exiting end of negative air pressure chamber 45 established by second open end 44. This additional negative air pressure assists the air that is flowing in negative air pressure chamber 45 to be evacuated from within negative air pressure chamber 45, thus reducing the drag within negative air pressure chamber 45. With the drag reduced, negative air pressure is efficiently established within tank 20.

While the present invention contemplates the negative air pressure applied to tank 20 as capable of draining all fluids from a tank such as liquid within a tank or air existing in an empty tank, the present invention is preferably used to evacuate air existing above a liquid in a liquid-containing tank. This preferred use permits repair of a puncture in a tank containing liquid. This repair is accomplished by the negative air pressure created within negative air pressure chamber 45 that evacuates air 100 existing above liquid 110 in tank 20. With puncture 120 in tank 20, liquid 110 contained therein drains through puncture 120, preventing repair of puncture 120. The negative air pressure created by nozzle 10 of the present invention draws a flow of air from outside of tank 20, through puncture 120, and through liquid 110 within tank 20, and the air flow is then drawn into negative air pressure chamber 45 along with air 100 existing above liquid 110 within tank 20 by the flow of air created by negative air pressure chamber 45. This flow of air into tank 20 through puncture 120 is sufficient to stop liquid 110 from draining through puncture 120. With liquid 110 no longer draining through puncture 120, puncture 120 can be repaired without the need for draining all of liquid 110 from tank 20.

Figure 2:
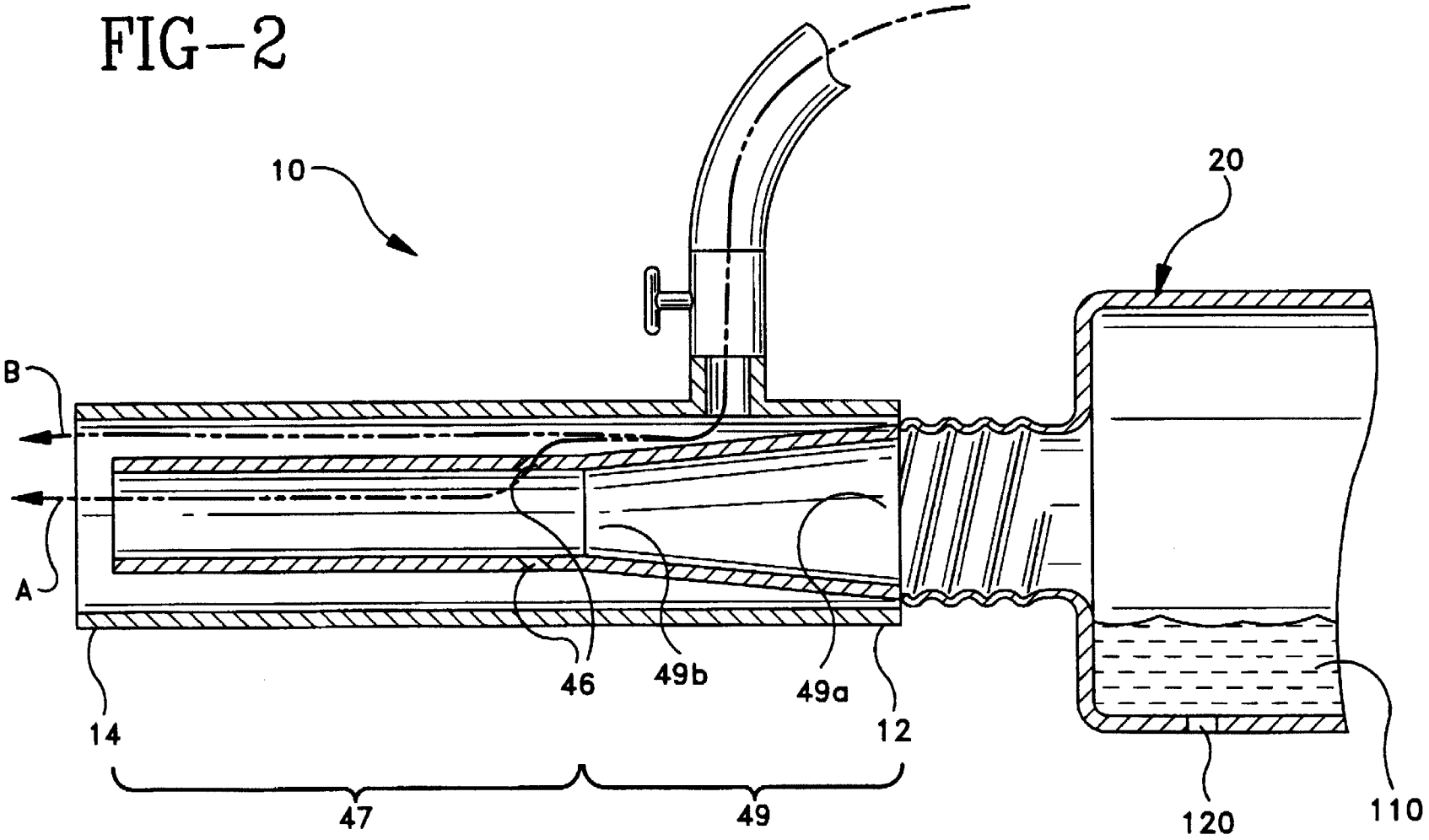
FIG. 2 is a side view of a nozzle in an alternative embodiment of the present invention.

In an alternative embodiment of the present invention as shown in FIG. 2, a conical portion 49 of vacuum pipe 40 may exist in a conical shape. Conical portion 49 is provided to assist the air within tank 20 to flow more efficiently through negative air pressure chamber 45. In such an embodiment, vacuum pipe 40 preferably exists as two discrete portions, generally elongated portion 47 and conical portion 49. As depicted in FIG. 2, conical portion 49 of vacuum pipe 40 is provided adjacent first open end 42 of vacuum pipe 40, which attaches to tank 20 at tank opening 30. Conical portion 49 has a larger diameter portion **49*a* and tapers to a smaller diameter portion 49*b*. When nozzle 10 is attached to tank opening 30, conical portion 49 is positioned such that larger diameter portion 49*a* is in communication with tank opening 30. Elongated portion 47 extends generally from smaller diameter portion 49*b* to second open end 44. In this alternative embodiment, openings 46 preferably exist through elongated wall 41 of vacuum pipe 40 at a position on elongated portion 47 adjacent smaller diameter portion 49*b*. This embodiment provides for fluid communication through negative air pressure chamber 45 in a similar manner as the preferred embodiment, with air 100 having a flow path from within tank 20, through tank opening 30, into first open end 42, through larger diameter portion 49*a* of conical portion 49, through smaller diameter portion 49*b* of conical portion 49, through elongated portion 47, and out second open end 44**.

Figure 3:
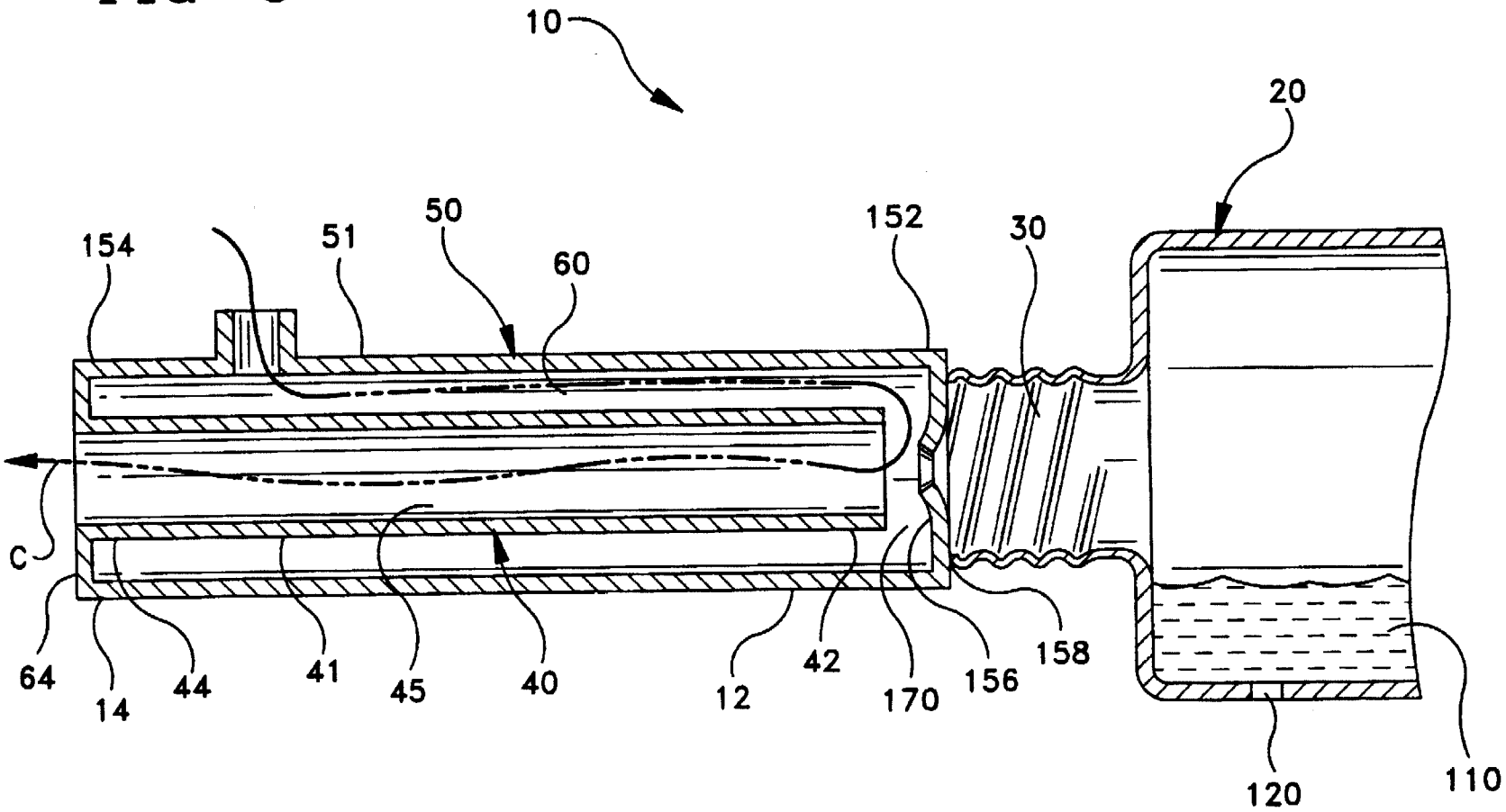
FIG. 3 is a side view of a nozzle in an alternative embodiment of the present invention.
Figure 4:
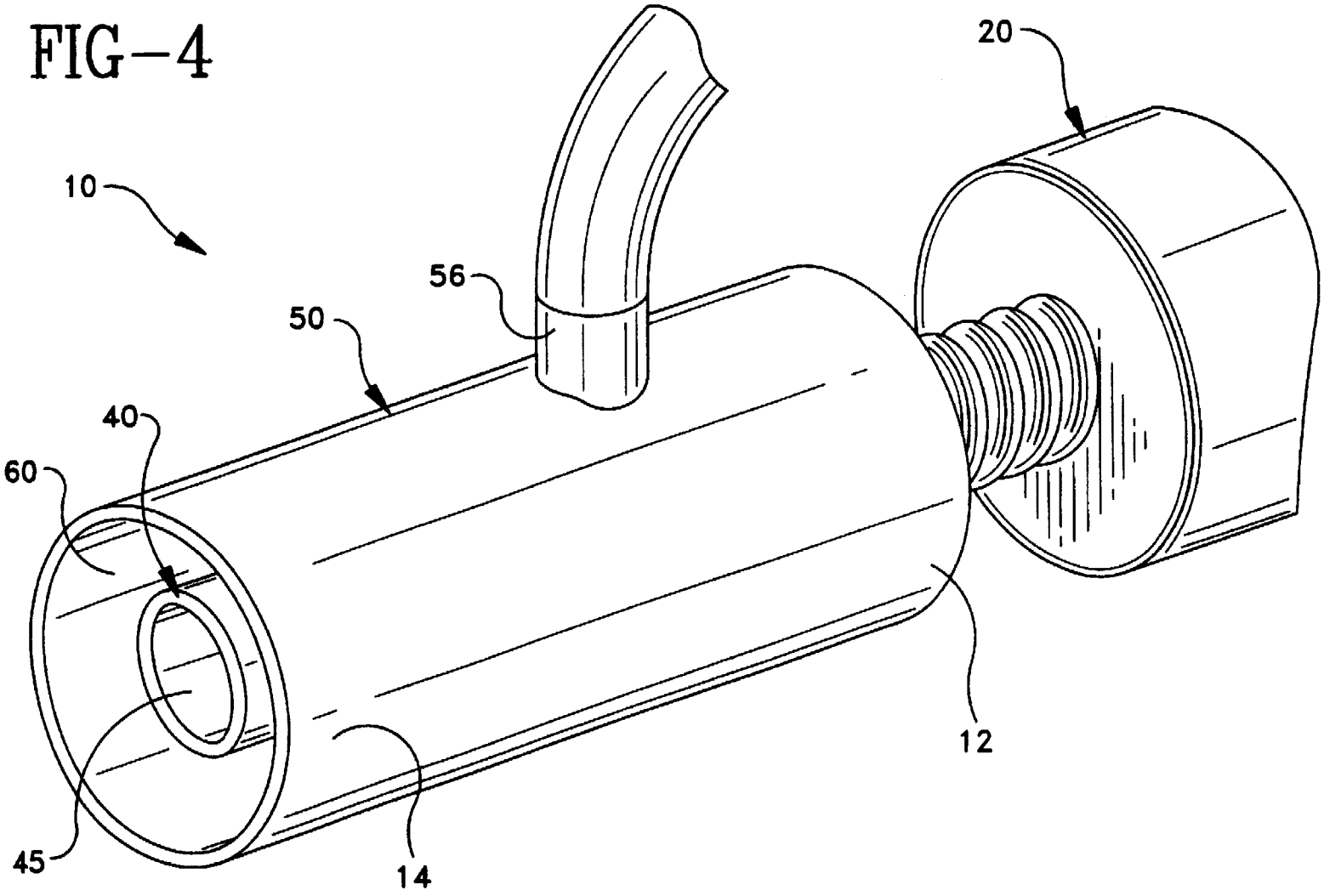
FIG. 4 is a perspective view of a nozzle of the present invention.

Referring to FIG. 3, an alternative embodiment of the present invention is shown. For ease of description, like reference numerals are used to identify components similar to those described above with reference to FIGS. 1 and 2. In the alternative embodiment of the invention as depicted in FIG. 3, a nozzle 10 is provided for attachment to tank opening 30 including vacuum pipe 40 having an elongated generally cylindrical wall 41. Vacuum pipe 40 has first open end 42 and second open end 44 spaced from first open end 42 and open to ambient air. Elongated wall 41 of vacuum pipe 40 defines a negative air pressure chamber 45 between first open end 42 and second open end 44 of vacuum pipe 40. Negative air pressure is established within negative air pressure chamber 45 which evacuates air from within tank 20 when nozzle 10 is attached at tank opening 30.

Nozzle 10 of this alternative embodiment also includes an air flow pipe 50 as in the preferred embodiment. Air flow pipe 50 also includes air inlet opening 56 capable of accommodating the flow of compressed air, as in the preferred embodiment.

In this alternative embodiment, air flow pipe 50 includes a first end 152 adjacent first open end 42 of vacuum pipe 40. Air flow pipe 50 further includes an air flow deflector surface 156 extending from first end 152 and into negative air pressure chamber 45 at first open end 42 of vacuum pipe 40. Deflector surface 156 exists about the circumference of first end 152 of air flow pipe 50. Deflector surface 156 establishes a path of fluid communication 170 between annular chamber 60 and negative air pressure chamber 45. Deflector surface 156 directs the air flow (shown as arrow C in FIG. 3) provided through annular chamber 60 to flow through path of communication 170 and into negative air pressure chamber 45. Deflector surface 156 is shaped in such as manner so as to direct the air flowing from annular chamber 60 into negative air pressure chamber 45 in a direction toward open end 42 of vacuum pipe 40. This directioning of air creates a flow of air through negative air pressure chamber 45, thus establishing negative air pressure within negative air pressure chamber 45 in a similar manner as created by the air flow through openings 46 in the preferred embodiment. It is preferred that deflector surface 156 be shaped in such a manner so as to establish an angle of 10 degrees at path of communication 170.

As in the preferred embodiment, any type of conventional coupling mechanism can be employed to secure nozzle 10 to tank 20. Preferably, an airtight engagement is established when nozzle 10 is attached to tank 20. It is contemplated that such an airtight engagement is accomplished by deflector surface 156 having an external surface 158 at first end 152 of air flow pipe 50, with external surface 158 being capable of securing nozzle 10 to tank 20 at or about the tank opening 30. External surface 158 may contain a resilient elastomer material at the point of attachment to tank 20, which will assist in establishing such an airtight engagement between nozzle 10 and tank 20.

In this alternative embodiment, it is preferable for path of communication 170 to be capable of adjustment between an open and a closed position. This adjustment capability permits path of communication 170 to act as a valve for regulating the flow of air therethrough. Such a regulation is desirable for adjusting the negative air pressure applied to tank 20 without the need for adjusting the flow of air into air inlet opening 56 by external adjustments. Deflector surface 156 may further include a material such as a resilient elastomeric material capable of establishing an air tight seal in path of communication 170 when path of communication 170 is in a closed position.

In the alternate embodiment, nozzle 10 includes an end wall 64 at the end of the nozzle which is adjacent second end 154 of airflow pipe 50 and second open end 44 of vacuum pipe 40. End wall 64 closes the end of annular chamber 60. End wall 64 is an annular member extending between air flow pipe 50 and vacuum pipe 40. End wall 64 may be secured to vacuum pipe 40 and movably positioned with respect to second end 154 of air flow pipe 50. Such securement may include a threadable engagement such as a screw threaded attachment of end wall 64 to second end 154 of air flow pipe 50. In this manner, end wall 64 and vacuum pipe 40 attached thereto are longitudinally movable with respect to air flow pipe 50. Such longitudinal movement causes end 42 of vacuum pipe 40 to move toward and away from deflector surface 156, thereby adjusting path of communication 170 between an open and a closed position. When path of communication 170 is closed, the air flow through path of communication 170 is blocked, and the negative air pressure established by this flow of air is subsequently stopped. In this manner, an adjustable path of communication 170 is created which is capable of regulating the flow of air therethrough, and thus regulating the amount of negative air pressure applied to tank 20.

It is also contemplated that path of communication 170 may be adjusted by providing deflector surface 156 as a discrete member. In this embodiment, first end 152 of air flow pipe 50 is capable of being movably accommodated by discrete deflector surface 156 so as to adjust path of communication 170 between an open and a closed position. This engagement is preferably accomplished by deflector surface 156 threadably accommodating first end 152 of air pipe 50. This threadable engagement permits air flow pipe 50 to be adjusted without movement of deflector surface 156. Since air flow pipe 50 is attached to vacuum pipe 40 at second end 154, vacuum pipe 40 moves along with air flow pipe 50 when adjusted. This movement causes path of communication 170 to be adjustable between an open and a closed position, in that movement of air flow pipe 50 and subsequently vacuum pipe 40 without movement of deflector surface 156 causes path of communication 170 to be opened or closed.

While the invention has been thus far described in terms of repairing a fluid-filled tank, it is contemplated that the nozzle of the present invention can be employed for a wide variety of uses with little modification. For example, the nozzle can be used as a blower device for blowing debris. In such a use, the nozzle is not attached to a tank as described above, but instead is open to ambient air at its first end 12. With first end 12 of nozzle 10 open to ambient air, the flow of air through negative air pressure chamber 45 draws the ambient air through first end 12 in a similar manner as in the preferred embodiment with the air was being drawn from within tank 20. It is preferred with such an embodiment that a filter (not shown) be incorporated into nozzle 10, preferably at the point where the ambient air is entering first end 12 of nozzle 10 and flowing into negative air pressure chamber 45, in order to prevent contaminants such as dirt from flowing with the outside air into nozzle 10. In operation, the air exiting second end 14 of nozzle is exiting at a higher air volume and air throughput than would be possible without nozzle 10. As such, the exiting air provides for a powerful stream of air flow, and an effective blower is created.

Another use contemplated by the present invention is an improved vacuum cleaner. In such a use, first end 12 of nozzle 10 which is typically attached to tank 20 is open to ambient air, and second end 14 of nozzle 10 which is typically open to ambient air contains a bag (not shown) attached thereto. In operation, air flowing through negative air pressure chamber 45 draws ambient air flow through first end 12 and into negative air pressure chamber 45. The air flow is discharged at second end 14 into the attached bag. The bag can contain small pores for permitting flow of the pressurized air therethrough. The draw of ambient air creates a vacuum that is useful for picking up debris in a similar manner as a conventional vacuum cleaner.

It is also contemplated that the present invention can be used to test equipment that operates in the presence of negative air pressure. For example, it is often necessary to test equipment such as door locks on cars that function through the use of a vacuum chamber. The present invention can be modified to accommodate such equipment and test such equipment for proper functioning. This use can be accomplished by modifying first end 12 of nozzle 10 which has heretofor been described as the point of attachment to tank 20. By modifying first end 12 for example by including a valve thereon, first end 12 can be made to accommodate such vacuum operable equipment, and operation of nozzle 10 to establish negative air pressure will provide a vacuum and function to test the equipment for proper working order.

Yet another use of the present invention involves increasing the efficiency of air operable devices such as air compressors. In operation, nozzle 10 of the present invention uses compressed air to establish a first fluid flow into negative air pressure chamber 45. This compressed air is typically a small volume of air, for example one gallon of air, applied through nozzle 10. In use, nozzle 10 uses this one gallon of compressed air to draw in a much larger volume of air, for example twenty-nine gallons, from first end 12 into negative air pressure chamber 45. Thus, air exits nozzle 10 at second end 14 in a much higher volume, i.e. thirty gallons, than the compressed air that is applied through air inlet opening 56. In the normal operation of a compressor (not shown), air is drawn into a large tank where it is compressed and stored for use. Often, a single compressor is used to operate a number of different tools and work stations. It is contemplated that second end 14 of nozzle 10 of the present invention could be attached to the air input of a compressor. With such an attachment, a much larger volume of air will be drawn into the compressor due to the high volume of air that is output through second end 14 of nozzle 10. In this manner, the compressor that is used to supply the compressed air to nozzle 10 of the present invention can be made to operate more efficiently.

Still another use for the nozzle of the present invention involves reducing frictional forces of moving vessels in water. For example, ships moving in water are subjected to a large amount of drag due to the frictional forces of the water through which they are moving. It is contemplated that the present invention can assist in reducing the amount of drag on such a vessel in an efficient manner. This is accomplished by providing the nozzle of the present invention on the front of such a vessel, with first end 12 thereof open to air flow from the front of the vessel, and with second end 14 thereof having a plurality of connectors. A covering such as a jacket that contains a plurality of air pockets covers at least a portion of the surface of the vessel that is in contact with water. The air pockets have small air outlets in communication with the water. The air pockets have an air inlet that is in communication with the second end of the nozzle attached to the front of the vessel. In operation, the nozzle establishes a flow of air therethrough, and a large volume of air is created at second end 14 thereof, as described above. This volume of air is directed through the connectors that exist at second end 14 of nozzle 10, and into the air pockets of the jacket surrounding the vessel. The air is then directed out the air outlets of the air pockets. This air flow forces the water that is in contact with the vessel away from the vessel, thus reducing the drag created by the water in contact with the vessel.

It is further contemplated by the present invention to incorporate multiple concentric tubes (not shown) similar to the concentric nature of vacuum pipe 40 and air flow pipe 50. Such a design using multiple concentric tubes provides for an improved device for providing negative air pressure. In such an embodiment, the concentric tubes preferably exist about ¼ inch apart, allowing for an annular chamber to exist between each concentric tube.

While the invention has been described with relation to certain preferred embodiments, it is understood that variations and modifications thereof will be readily apparent to those skilled in the art in light of the above teaching.

What is claimed:

1. A nozzle for attachment to a fluid-containing tank for applying negative air pressure to the interior thereof through an opening in said tank, said nozzle comprising:

a vacuum pipe having an elongated generally cylindrical wall having a first open end adapted to be in communication with said tank opening and a second open end spaced therefrom, said vacuum pipe defining a negative air pressure chamber between said ends; and an air flow pipe having an elongated generally cylindrical wall surrounding said vacuum pipe and defining an annular chamber therebetween, said air flow pipe having an open end adjacent said second open end of said vacuum pipe, said air flow pipe including an air inlet opening for establishing air flow through said annular chamber and out said open end of said air flow pipe;

said vacuum pipe including an opening through said wall between said first open end and said second open end thereof for permitting said air flow established through said annular chamber to pass through and into said negative air pressure chamber and out the open end thereof;

whereby negative air pressure is applied to the interior of said tank.

2. A nozzle as in claim 1, wherein said vacuum tube includes a plurality of openings existing through said wall between said first open end and said second open end thereof for permitting said air flow established in said annular chamber to pass through and into said negative air pressure chamber and out the open end thereof.

3. A nozzle as in claim 2, wherein said plurality of openings are generally cylindrical in shape.

4. A nozzle as in claim 2, wherein said plurality of openings are geometrically shaped to direct said air flow passing through said openings towards said second open end of said vacuum pipe.

5. A nozzle as in claim 1, wherein said vacuum pipe has a conical portion adjacent said first open end thereof, and an elongated portion extending from said conical portion to said second open end.

6. A nozzle as in claim 5, wherein said opening through said wall is present in said elongated portion of said vacuum pipe at a position adjacent said conical portion.

7. A nozzle as in claim 1, wherein said air flow pipe includes an end wall surrounding said vacuum pipe adjacent said first open end of said vacuum pipe, said end wall closing the other end of said air flow pipe.

8. A nozzle as in claim 7, wherein said end wall is capable of securing said nozzle to said tank in an airtight engagement.

9. A nozzle as in claim 8, wherein said end wall includes a resilient elastomer material.

10. A nozzle as in claim 1, further comprising an arm for introduction into said tank opening, said arm capable of engaging a door of said tank and maintaining said door of said tank in an open position.

11. A nozzle as in claim 1, wherein said air inlet opening includes a valve for regulating said air flow through said annular chamber.

12. A nozzle as in claim 1, wherein said open end of said air flow pipe extends beyond the length of said vacuum pipe.

13. A nozzle as in claim 12, wherein said open end of said air flow pipe extends more than ¼ inch beyond the length of said vacuum pipe.

14. A nozzle as in claim 13, wherein said open end of air flow pipe extends ½ inch beyond the length of said vacuum pipe.

15. A nozzle for establishing negative air pressure comprising:

a vacuum pipe having an elongated generally cylindrical wall having a first open end and a second open end spaced therefrom, said vacuum pipe defining a negative air pressure chamber between said ends; and an air flow pipe having an elongated generally cylindrical wall surrounding said vacuum pipe and defining an annular chamber therebetween, said air flow pipe having an open end adjacent said second open end of said vacuum pipe, said air flow pipe including an air inlet opening for establishing air flow through said annular chamber and out said open end of said air flow pipe;

said vacuum pipe including an opening through said wall between said first open end and said second open end thereof for permitting said air flow established through said annular chamber to pass through and into said negative air pressure chamber and out the second open end thereof;

whereby negative air pressure is established.

* * * * *